United States Patent [19]

Faucher et al.

[11] 4,418,543

[45] Dec. 6, 1983

[54] FUEL NOZZLE FOR GAS TURBINE ENGINE

[75] Inventors: Joseph E. Faucher, East Hartford; Richard R. Wright, Willimantic; Francis C. Pane, Jr., South Windsor; David Kwoka, Windsor; Edmund E. Striebel, South Windsor, all of Conn.

[73] Assignee: United Technologies Corporation, Hartford, Conn.

[21] Appl. No.: 212,176

[22] Filed: Dec. 2, 1980

[51] Int. Cl.[3] ..... F02C 7/22

[52] U.S. Cl. ..... 60/742; 60/748; 239/404; 239/406

[58] Field of Search ..... 60/742, 39.06, 748; 239/400, 403, 404, 405, 406

[56] References Cited

U.S. PATENT DOCUMENTS

| | | | |
|---|---|---|---|
| 2,701,164 | 2/1955 | Purchas, Jr. et al. | 60/742 X |
| 3,013,732 | 12/1961 | Webster et al. | 60/742 X |
| 3,285,007 | 11/1966 | Carlisle et al. | 60/748 X |
| 3,684,186 | 8/1972 | Helmrich | 239/400 |
| 3,937,011 | 2/1976 | Carvel et al. | 60/748 X |
| 4,342,198 | 8/1982 | Willis | 239/400 X |
| 4,362,022 | 12/1982 | Faucher et al. | 60/742 |

*Primary Examiner*—Carlton R. Croyle
*Assistant Examiner*—Donald E. Stout
*Attorney, Agent, or Firm*—Norman Friedland

[57] ABSTRACT

A fuel nozzle designed to reduce pollutant emissions and minimize the buildup of coke in the secondary fuel passage of a dual orifice fuel nozzle for the combustor of a gas turbine engine sizes the orifices and passages of the air and fuel so as to increase the pressure in the secondary passage during its inoperative mode and when the primary fuel passage is in the operative mode and having the air and fuel issuing from both the primary and secondary orifices swirl in the same direction.

2 Claims, 1 Drawing Figure

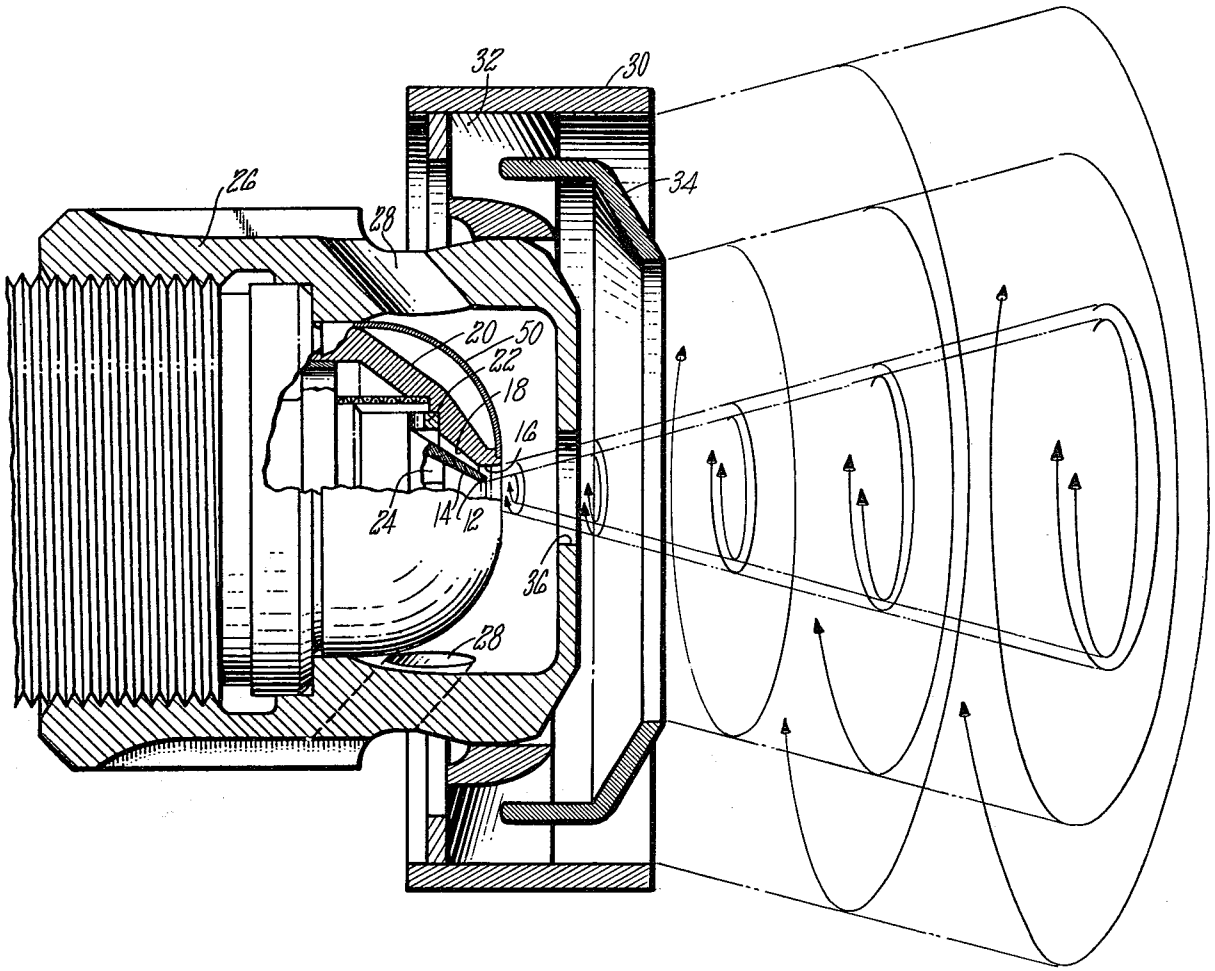
30
34
32
50
22
18
16
20
36
12
14
28
24
26

FUEL NOZZLE FOR GAS TURBINE ENGINE

TECHNICAL FIELD

This invention relates to fuel nozzles for turbine type of power plants and particularly to dual orifice nozzles and means for improving the quality of emissions.

BACKGROUND ART

In view of the ecological concern and the governmental requirements for the reduction of pollutants admitted into the atmosphere, there has been a concerted effort to improve the quality of the exhaust discharging from aircraft engines.

One of the major areas that is currently being explored is the engines combustor and its attendent fuel nozzle.

The purpose of this invention is to reduce the emissions from the gas turbine engines powering aircraft. In particular, we have found that by certain modifications already existing fuel nozzles, it is possible to significantly reduce the pollutant emissions. To this end the swirl is selected so that both air and/or fuel when issuing to the combustion zone is in the same direction.

DISCLOSURE OF INVENTION

It is an object of this invention to provide for a fuel nozzle of the type having primary and secondary fuel feed orifices for a combustor of a gas turbine engine means for imparting swirl to the fuel and air in the same direction.

A feature of this invention is to judiciously select the value of the area ratio of air inlet and fuel/air outlet to produce a positive pressure inside the nozzle relative to the pressure in the burning zone in the combustor in combination with co-rotational fuel and air.

A feature of this invention is to provide for a gas turbine engine, co-rotational fuel and air egression into the combustion zone of the combustor for reducing hydrocarbons, $NO_x$, and carbon monoxide emissions.

Other features and advantages will be apparent from the specification and claims and from the accompanying drawings which illustrate an embodiment of the invention.

BRIEF DESCRIPTION OF THE DRAWING

The sole FIGURE is an enlarged view partly in section and partly in elevation illustrating the details of this invention.

BEST MODE FOR CARRYING OUT THE INVENTION

The fuel nozzle generally illustrated by reference numeral 10 is of the type that is utilized on the JT-8D and JT-9D engines manufactured by Pratt & Whitney Aircraft Group of United Technologies Corporation, the assignee of this patent application and are incorporated herein by reference.

Suffice it to say that the nozzle comprises a primary fuel feed orifice 12 formed in the generally conically shaped primary nozzle 14 and a second fuel feed orifice 16 communicating with the annular passageway 18 defined between the spaced conical nozzle element 20 and the primary nozzle 14. Swirl ring 22 and swirl plug 24 serve to impart a tangential velocity to the fuel before issuing into the combustion zone and produce the flow pattern illustrated.

A portion of air from the compressor is admitted internally in nozzle nut 26 through swirl slots 28 and likewise impart a tangential velocity to the air as it progresses into the combustion zone as shown by the flow pattern.

Air is also introduced around the fuel through the swirl cup 30 with an imparted tangential velocity by the swirl vanes 32. Splitter 34 may be employed as shown. As noted, the flow pattern is as indicated.

As will be apparent to one skilled in the art, the direction of swirl and the tangential component is dictated by the vanes and swirl slots. According to this invention both air and fuel issuing into the combustion zone rotate in the same direction.

It is important in the context of this invention that the pressure inside the secondary fuel nozzle 20 upstream of orifice 16 is higher than the pressure downstream thereof when primary fuel only is flowing. Also in its preferred embodiment it was found that good emission results were achieved when the area of annular discharge orifice area defined between the depending lip 36 of nozzle nut 26 and the fuel nozzle heat shield (50), and the area of orifice 36 were substantially equal.

To assure the proper pressure level the number of swirl slots 28 of the original nozzle nut was increased from 8 to 16 for an area of 0.206 square inch.

Actual engine test ran with these modifications in comparison with the heretofore used nozzles showed a substantial reduction in carbon monozide, hydrocarbons and $NO_x$ emissions.

It should be understood that the invention is not limited to the particular embodiments shown and described herein, but that various changes and modifications may be made without departing from the spirit and scope of this novel concept as defined by the following claims.

We claim:

1. A dual orifice type fuel nozzle having a primary fuel passage normally continuously operative throughout the engine operating envelope and a secondary fuel passage normally operative solely during the high thrust regimes and inoperative during the low thrust regimes of said engine operating envelope, for a combustor of gas turbine engine having a compressor, said fuel nozzle having a generally conically shaped casing with a primary fuel passage centrally disposed therein, secondary fuel passage formed therein concentrically disposed relative to the primary fuel passage, both primary and secondary passages exiting fuel into said combustor through a substantially mutual transverse plane, means for imparting a swirl component to compressor discharge air surrounding the fuel exiting from said primary and secondary passages, means for pressurizing the secondary passage when said primary passage is solely operative with said compressor discharge air whereby said secondary passage maintains a positive pressure for preventing fuel from said primary passage from migrating therein and coking the walls of said secondary passage, first fuel swirl means in said primary passage for imparting a swirl motion to the fuel issuing therefrom, second fuel swirl means in said secondary passage for imparting a swirl motion to the fuel issuing therefrom, said first fuel swirl means, said second fuel swirl means and said means for swirling the air imparting swirling motion in a common direction.

2. A dual orifice type fuel nozzle as in claim 1 wherein said means for pressurizing said secondary passage is solely external of said secondary passage so that compressor air does not flow through said secondary passage.

* * * * *